US008210669B2

(12) United States Patent
Komaki

(10) Patent No.: US 8,210,669 B2
(45) Date of Patent: Jul. 3, 2012

(54) FLUID CONTAINER

(75) Inventor: Takeshi Komaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 69 days.

(21) Appl. No.: 12/914,791

(22) Filed: Oct. 28, 2010

(65) Prior Publication Data

US 2011/0100998 A1 May 5, 2011

(30) Foreign Application Priority Data

Oct. 29, 2009 (JP) ..... 2009-248538

(51) Int. Cl.
*B41J 2/175* (2006.01)

(52) U.S. Cl. ..... 347/86

(58) Field of Classification Search ..... 347/86, 347/87

See application file for complete search history.

(56) References Cited

U.S. PATENT DOCUMENTS 6,106,112 A * 8/2000 Okubo et al. ..... 347/86
6,281,911 B1 8/2001 Nakazawa et al.
6,416,166 B1 * 7/2002 Robinson et al. ..... 347/49
7,192,128 B1 * 3/2007 Hattori et al. ..... 347/86

FOREIGN PATENT DOCUMENTS

JP 2001-353882 A 12/2001
JP 2002-307705 A 10/2002
JP 2002-307720 A 10/2002
JP 3533897 B2 5/2004

* cited by examiner

*Primary Examiner* — Anh T. N. Vo

(74) *Attorney, Agent, or Firm* — Kilpatrick Townsend & Stockton LLP

(57) ABSTRACT

The cartridge case of an ink cartridge has cover panels removably attached to both sides of a case core. A locking mechanism that can be disengaged and holds the cover panels to the case core forcibly elastically deforms the first latch plates of the cover panel, and engages or disengages the first protruding catch of the case core. Elastic deformation of the first latch plates is limited by the locking tab of the other cover panel, and as long as the other cover panel is not removed from the case core, the locking mechanism will not disengage and the one cover panel will not separate from the case core.

9 Claims, 8 Drawing Sheets

FLUID CONTAINER

This application claims priority to Japanese Patent Application No. 2009-248538, filed Oct. 29, 2009, the entirety of which is incorporated by reference herein.

BACKGROUND

1. Technical Field

The present invention relates to a fluid container that is used as an ink cartridge in an inkjet printer, for example.

2. Related Art

Ink cartridges for inkjet printers may have a storage unit for ink sacks that hold fluid ink for supply to the print head, and a waste ink recovery unit containing a waste ink sponge that absorbs waste ink fluid discharged from the inkjet print head, disposed inside an ink cartridge case as taught in Japanese Patent No. 3533897 and Japanese Unexamined Patent Appl. Pub. JP-A-2001-353882. Ink cartridges that have a waste ink sack inside the cartridge case instead of a waste ink sponge are also described in Japanese Unexamined Patent Appl. Pub. JP-A-2002-307705 and Japanese Unexamined Patent Appl. Pub. JP-A-2002-307720, for example.

When an ink cartridge is loaded into the ink cartridge loading unit of the inkjet printer, an ink supply path formation member and waste ink recovery path formation member disposed on the ink cartridge loading unit side are inserted to an ink supply port and a waste ink recovery port formed in the cartridge case so that ink can be supplied from the ink cartridge and waste ink can be recovered from the inkjet printer. For example, an ink supply needle and a waste ink recovery needle disposed on the ink cartridge loading unit side respectively push open an ink supply needle insertion port and a waste ink recovery needle insertion port formed in the cartridge case and are inserted to the ink sack and waste ink recovery unit so that ink can be supplied and waste ink can be recovered.

With this type of ink cartridge, however, the main container can preferably be disassembled and the ink supply sack and waste ink recovery member replaced with new ones when the ink supply is depleted or the waste ink recovery unit becomes filled with waste ink so that the main container can then be reassembled and reused to conserve resources.

So that the main container of an ink cartridge or other fluid container can be disassembled and then reassembled, the main container may be rendered from a plurality of container forming members that are assembled and held together by a locking mechanism that can hold and release the container forming members. One such locking mechanism known from the literature has at least one protruding tab or latch formed on one container forming member that rides over while elastically deforming a matching hook or catch formed on another container forming member so that the latch and hook engage when the hooks elastically return to the original position. To disengage this connection, the hooks are elastically deformed by force and separated from the latches.

To facilitate disassembly and reassembly of the main container in a fluid container having a main container assembled by connecting a plurality of container forming members together by means of such a locking mechanism, the length of the hook (lance) may be increased for greater flexibility, or the engagement of the hook and latch may be reduced so that the hooks can be easily disengaged from the latches. However, because such methods weaken the engagement force of the locking mechanism, the locking mechanism can be easily disengaged by the force of impact of being dropped, for example, and the main container may be easily broken. Conversely, if the length of the lance (hook) is shortened or the amount of engagement is increased, disassembly and reassembly of the main container becomes more difficult. In addition, because great force is required to release the engagement, stress is concentrated at the base of the hook, for example, and when the main container is made of plastic, the engaging parts may be plastically deformed, stress whitened (blushing), and embrittled.

SUMMARY

A fluid container according to the present invention for use in ink cartridges, for example, is easy to assemble and disassemble, and prevents the parts of the main container from being disengaged and the main container coming apart as a result of shock when the fluid container is dropped, for example. The fluid container of which the main container is assembled from at least three separable container parts that are connected to each other so that the container parts will not come apart and the fluid container will not fail when subject to impact from being dropped, for example.

A first aspect of the invention is a fluid container including a main container; and a fluid storage unit that is formed inside the main container. The main container is composed of at least three members including a first container forming member, a second container forming member and a third container forming member. The second container forming member and the third container forming member are removably attached to the first container forming member with the first container forming member therebetween. A locking mechanism for removably attaching the second container forming member to the first container forming member includes a first engaging unit formed to the first container forming member, a second engaging unit formed to the second container forming member, and an engagement holding unit disposed to the third container forming member. The second engaging unit engages the first engaging unit and can be elastically deformed and separated from the first engaging unit, and the engagement holding unit restricts elastic deformation of the second engaging unit so that the second engaging unit does not separate from the first engaging unit.

With the fluid container according to this aspect of the invention, elastic deformation of the second engaging unit that is elastically deformed for separation from the first engaging unit is limited by the engagement holding units. To disassemble the main container, the third container forming member that is removably attached to the first container forming member is first removed from the first container forming member. This eliminates restriction of the second engaging unit by the engagement holding units formed on the third container forming member, and enables the second engaging unit to be elastically deformed and separated from the first engaging unit. The second container forming member can then be removed from the first container forming member by forcibly elastically deforming the second engaging unit and disengaging the first engaging unit.

Even if the length of the second engaging unit is set so that the second engaging unit can be easily elastically deformed or the first and second engaging units are only slightly engaged so that the first engaging unit and second engaging unit can be easily disengaged, the first container forming member and second container forming member will not be disengaged and separate when a strong impact is applied because elastic deformation of the second engaging unit is restricted by the engagement holding units. In addition, if the third container forming member is separated from the first container forming member, the first container forming member can be easily separated from the second container forming member with little force. Yet further, because there is not a large concentration of stress at the base of the elastically deformable second engaging unit, plastic deformation, stress whitening, and embrittlement of the base due to the normal forces of assembly and disassembly, or drop impact, can be avoided when the main container is plastic.

In another aspect of the invention, the first container forming member has a limiting unit that restricts movement of the engagement holding unit away from the second engaging unit.

When the third container forming member temporarily shifts relative to the first container forming member due to the force of impact when the fluid container is dropped, for example, restriction of the second engaging unit may be temporarily relieved if the engagement holding units moves or elastically deforms greatly in the direction away from the second engaging unit. As a result, the second engaging unit may elastically deform greatly and separate from the first engaging unit, and the main container may come apart and be damaged. Because movement of the engagement holding unit is limited so that it will not move in the direction away from the second engaging unit in this aspect of the invention, such problems can be prevented from happening.

Yet further preferably in a fluid container according to another aspect of the invention, when the first container forming member has a first side and a second side that functions as a limiting unit disposed opposite the first side with a specific gap therebetween, the first engaging unit can be a protruding catch that protrudes from the first side toward the second side. In addition, the second engaging unit may be a latch plate that extends in a direction along the first side; and the latch plate may have an inside engaging edge that engages the protruding catch from a direction along the first side, and can deform elastically away from the first side. In this configuration, the engagement holding unit is a locking tab that extends in a direction along the first side between the latch plate and the second side; and the locking tab holds at least part of the latch plate between the locking tab and the first side.

A fluid container according to another aspect of the invention preferably also has a second locking mechanism that removably attaches the third container forming member to the first container forming member and is similar to the locking mechanism described above. That is, the second locking mechanism includes a second protruding catch that protrudes from the first side of the first container forming member toward the second side, and a second latch plate formed on the third container forming member. The second latch plate has an inside engaging edge that extends in a direction along the first side and engages the protruding catch from a direction along the first side, and the second latch plate disengages the second protruding catch when elastically deformed in the direction away from the first side.

In another aspect of the invention, the locking mechanism is disposed at plural locations a specific interval apart along the outside edge of the first container forming member.

In yet another aspect of the invention, when a frame member of which both ends are open is used as the first container forming member, the second container forming member can be a first cover panel that closes a first opening on one side of the frame member, and the third container forming member can be a second cover panel that closes a second opening on the other side of the frame member.

In this configuration, a plurality of slots of a specific width and specific length that pass through from the first cover panel to the second cover panel are formed in the frame member at positions corresponding to the locations of the locking mechanisms, the side surface of each slot positioned on the inside side of the frame member is used as the first side, and the side surface positioned on the outside side is used as the second side. The latch plate of the locking mechanism is inserted to each slot from the first opening side, and the locking tab is inserted from the second opening side.

In another aspect of the invention, the fluid storage unit includes a supply fluid storage unit that stores a supply fluid, and a recovery fluid storage unit that stores a recovery fluid that is recovered from an external source. Either the supply fluid storage unit or the recovery fluid storage unit is disposed on the first cover panel side, and the other is disposed on the second cover panel side. A supply fluid port for supplying supply fluid from the supply fluid storage unit to an external device, and a fluid recovery port for recovering fluid from an external device to the recovery fluid storage unit, are formed in the frame member.

The fluid container of the invention can be used as an ink cartridge for an inkjet printer. In this configuration, the supply fluid storage unit is used as a supply ink storage unit for storing ink that is supplied to an inkjet printer, and the recovery fluid storage unit is used as a waste ink storage unit for recovering waste ink discharged from the inkjet printer.

A fluid container according to another aspect of the invention has a first container forming member that has a divider panel part, an inside frame panel part formed to surround the divider panel part, and a outside frame panel part that is connected to the inside frame panel part and is formed around the inside frame panel part; and a second container forming member and a third container forming member that are removably attached to the first container forming member with the divider panel part of the first container forming member therebetween; wherein the first container forming member includes a first protruding catch that is formed on the inside frame panel part protruding toward the outside frame panel part, and a second protruding catch; the second container forming member includes an elastically deformable first latch plate that is a first latch plate with a first engaging hole for engaging the first protruding catch; and the third container forming member includes an elastically deformable second latch plate that is a second latch plate with a second engaging hole for engaging the second protruding catch, and an engagement holding unit that contacts part of the first latch plate and limits elastic deformation of the first latch plate to the outside frame panel part side.

Effect of the Invention

As a locking mechanism for disconnectably assembling the first container forming member and second container forming member of the main container of the fluid container, a fluid container according to the invention uses a mechanism that disengages a first engaging unit and second engaging unit when the second engaging unit is elastically deformed by force. Elastic deformation of the second engaging unit is restricted by an engagement holding units rendered to a third container forming member that is removably attached to the first container forming member. Therefore, unless the third container forming member is removed from the first container forming member, the locking mechanism will not disengage and the second container forming member will not separate from the first container forming member. As a result, a locking mechanism that requires little force to disengage can be used while the main container can be prevented from coming apart when dropped, for example.

In addition, when elastic deformation of the engagement holding units is restricted by a limiting unit disposed to the first container forming member, elastic deformation or movement of the engagement holding units is restricted by the limiting unit even if the third container forming member moves temporarily due to the force of impact from being dropped. As a result, the engagement holding units can be prevented separating greatly from the second engaging units and disengaging, and the second container forming member can be prevented from separating from the first container forming member.

In addition, when the third container forming member is assembled to the first container forming member by a similar locking mechanism, the third container forming member can be prevented from separating from the first container forming member because slippage of the third container forming member to the first container forming member is suppressed.

Other objects and attainments together with a fuller understanding of the invention will become apparent and appreciated by referring to the following description and claims taken in conjunction with the accompanying drawings.

DESCRIPTION OF EMBODIMENTS

An ink cartridge for an inkjet printer according to a preferred embodiment of the invention is described below with reference to the accompanying figures.

General Configuration of an Inkjet Printer

Figure 1:
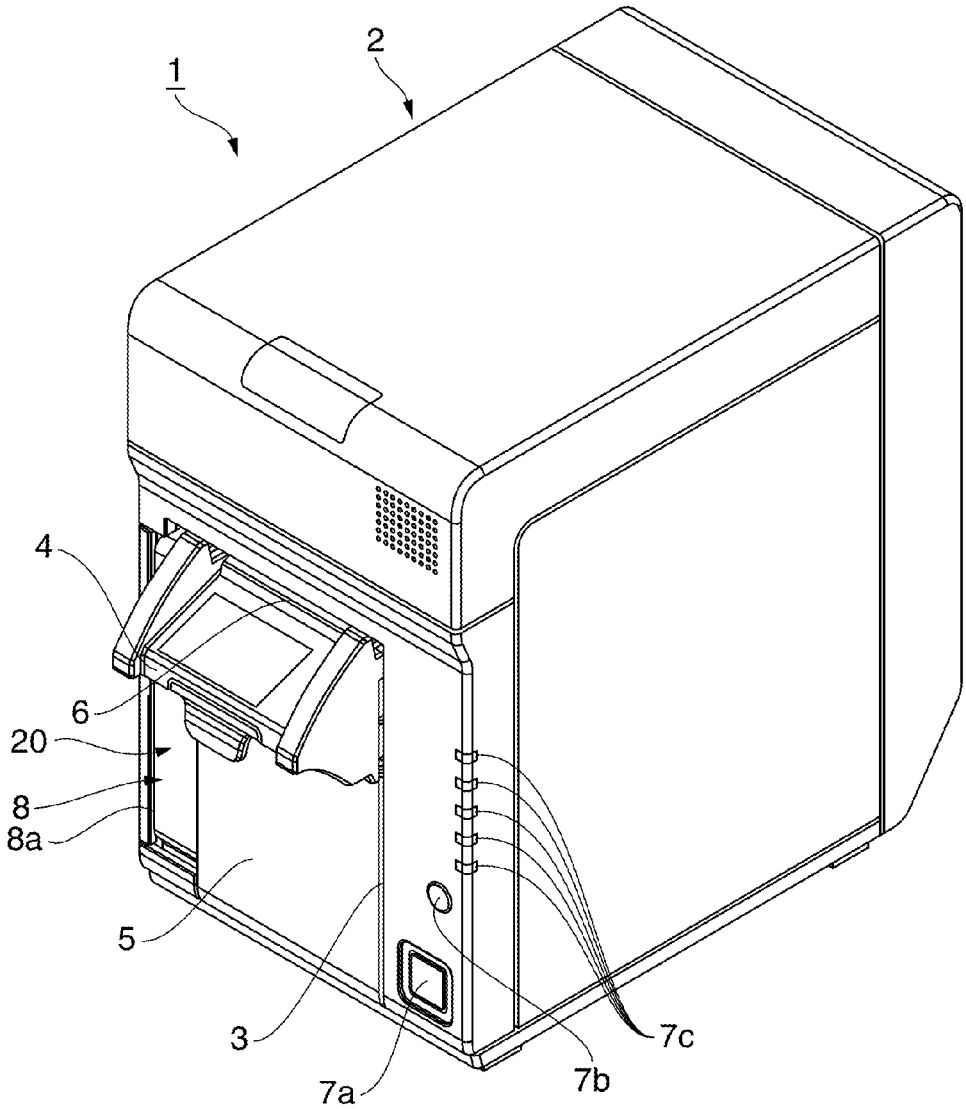
FIG. 1 is an external oblique view of an inkjet printer using an ink cartridge according to the invention.

FIG. 1 is an external oblique view showing an example of an inkjet printer that uses an ink cartridge (fluid container) according to the invention. The inkjet printer 1 shown in plural different colors of ink, and has a generally box-shaped printer case 2. An opening 3 for loading roll paper is formed in the front center part of the printer case 2. An access cover 5 to which a recording paper discharge guide 4 is disposed at the top is attached so that it can open and close to the opening 3. A recording paper exit 6 is formed between the recording paper discharge guide 4 and the top edge part of the opening 3 in the printer case 2. When a lock mechanism not shown is released and the recording paper discharge guide 4 is pulled forward, the access cover 5 can pivot forward at the bottom end thereof from the closed position shown in the figure to an open position.

A power switch 7*a*, paper feed switch 7*b*, and a plurality of operating status indicators 7*c* are arrayed at the right side of the access cover 5 at the front of the printer case 2. A loading opening 8*a* for an ink cartridge loading unit 8 that is rectangular in section and is disposed with the long side extending in the front-back direction of the printer is formed in the front of the printer case 2 on the left side of the access cover 5, and an ink cartridge 20 according to the invention is loaded in this ink cartridge loading unit 8.

Figure 2:
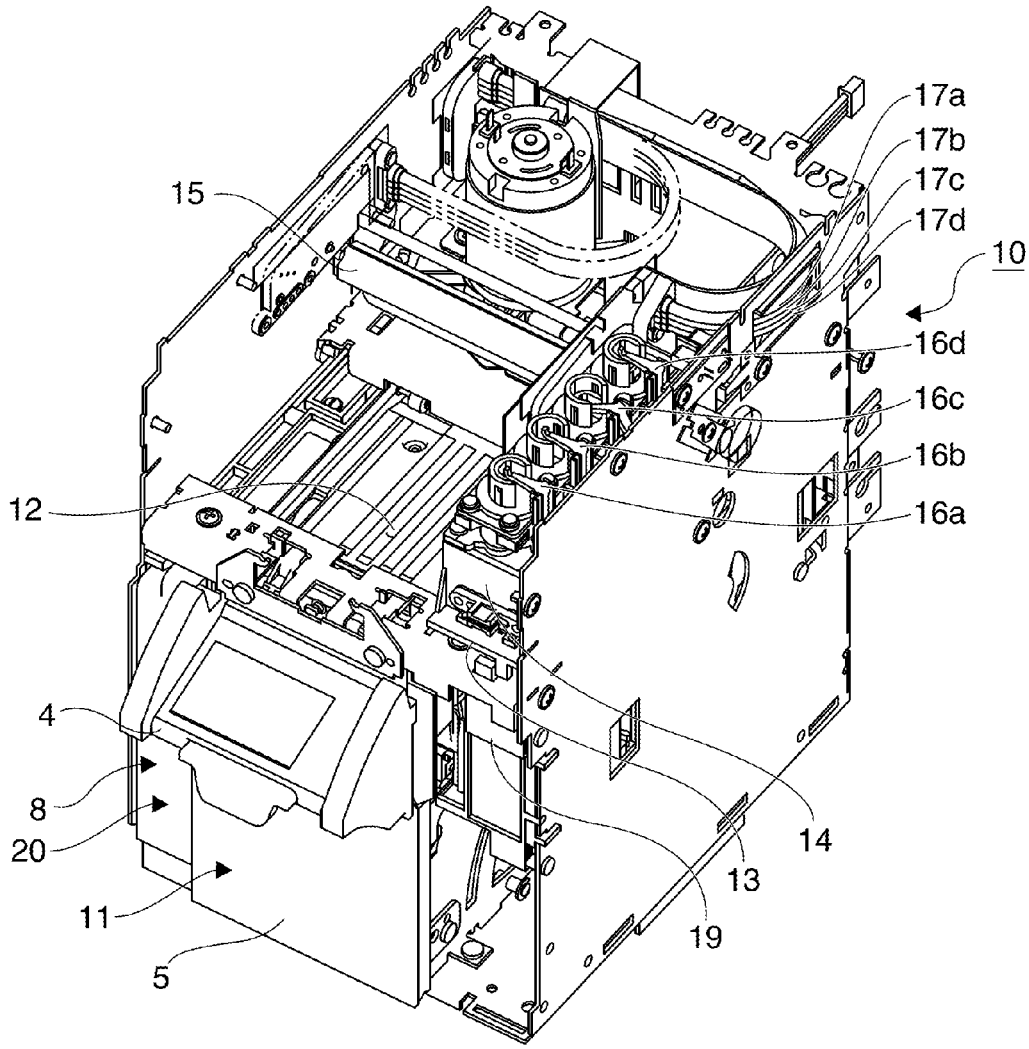
FIG. 2 is an oblique view showing the internal configuration of the inkjet printer shown in FIG. 1.

FIG. 2 is an oblique view of the print mechanism unit 10 that is covered by the printer case 2 inside the inkjet printer 1. A roll paper storage compartment 11 is formed in the print mechanism unit 10 in the center, and when the access cover 5 opens, this roll paper storage compartment 11 is open at the front and the roll paper can be replaced, for example. A platen 12 extends widthwise to the printer above the roll paper storage compartment 11, and a carriage 14 on which an inkjet head 13 is mounted is disposed above the platen 12. The carriage 14 can move along a carriage guide shaft 15 extending widthwise to the printer parallel to the platen 12.

An ink pump for each color of ink, such as ink pumps 16*a* to 16*d* storing the four colors of ink cyan, magenta, yellow, and black, are disposed to the carriage 14, and one end of a flexible ink tube 17*a* to 17*d* is connected to each of the ink pumps 16*a* to 16*d*. The other ends of the flexible ink tubes 17*a* to 17*d* are respectively connected to four ink supply paths (not shown in the figure) disposed vertically at a position at the back end of the ink cartridge loading unit 8. Each of the ink supply paths communicates with the ink cartridge 20 loaded in the ink cartridge loading unit 8.

A head maintenance unit 19 is disposed at a position separated to the right side from the platen 12. Maintenance operations such as discharging ink droplets not used for printing and suctioning ink from the ink nozzles is performed when the inkjet head 13 mounted on the carriage 14 is in the home position shown in FIG. 2 opposite the head maintenance unit 19. Waste ink discharged from the inkjet head 13 is recovered through a waste ink recovery path not shown from the head maintenance unit 19 to the ink cartridge 20 installed in the ink cartridge loading unit 8. The head maintenance unit 19 also has a pump, such as a tube pump, that sends the waste ink fluid toward the ink cartridge 20.

General Configuration of the Ink Cartridge

Figure 3A:
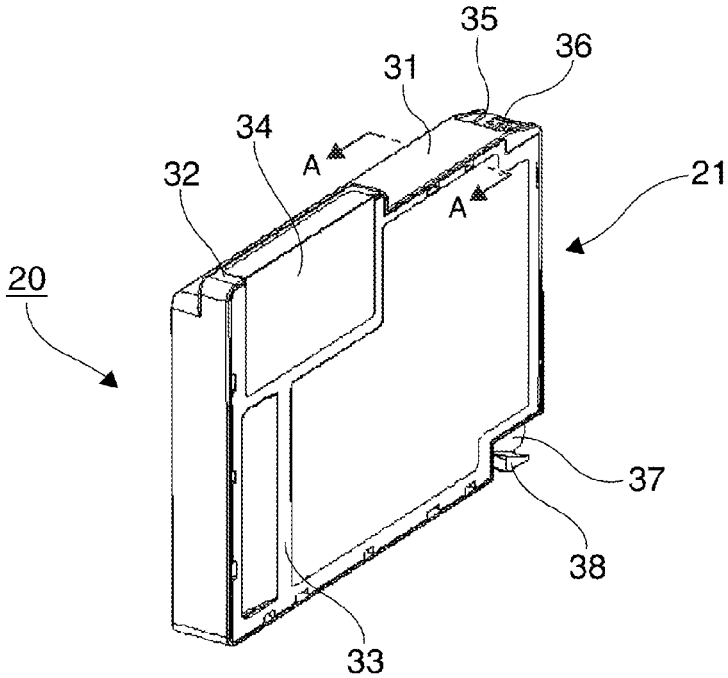
FIG. 3A and FIG. 3B are back and front oblique views of the ink cartridge.
Figure 3B:
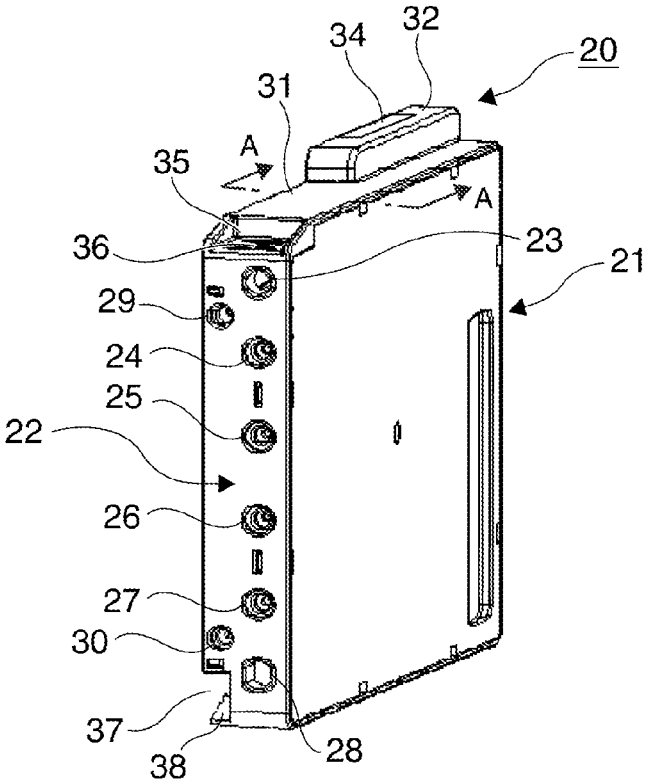

FIG. 3A is an oblique view showing the back end of the ink cartridge 20 when seen from the direction in which the ink cartridge 20 is inserted to the ink cartridge loading unit 8, and FIG. 3B is an oblique view showing the front of the ink cartridge 20 when seen from the direction in which the ink cartridge 20 is loaded.

The ink cartridge 20 has a cartridge case 21 (main container) with a flat, rectangular box-like shape that is long in the direction of insertion to the ink cartridge loading unit 8. Inside the cartridge case 21, an ink storage unit 48 (supply fluid storage unit) is formed on one side of the width perpendicular to the loading (insertion) direction as described below with reference to FIG. 4, and a waste ink storage unit 49 (recovery fluid storage unit) is formed on the other side. A plurality of ink sacks, specifically four ink sacks 54 to 57 storing cyan, magenta, yellow, and black ink in this embodiment of the invention, are stored in the ink storage unit 48.

The front face 22 of the cartridge case 21 in the loading direction is rectangular, and has a plurality of holes formed therein. A positioning pin insertion hole 23, a plurality of ink supply needle insertion holes 24 to 27 equal to the number of stored ink sacks, that is, four in this embodiment of the invention, and a rotation prevention pin insertion hole 28 are formed in order from the top on one side of the width (that is, the short side) of the front face 22 of the cartridge case 21 in this embodiment of the invention. On the other side of the width (short side), a waste ink recovery needle insertion hole 29 is formed at a position near the top, and an air needle insertion hole 30 is formed at a position near the bottom.

A rectangular protruding face 32 that is approximately half the width of the top surface 31 of the cartridge case 21 is formed protruding upward from the top surface 31 at a position at the back side in the insertion direction. A rectangular label 34 on which ink cartridge information is printed is affixed to this protruding face 32 and one side surface 33 of the cartridge case 21. A recessed shoulder 35 is formed to the top surface 31 of the cartridge case 21 at the front end in the insertion direction, and an IC chip 36 to which ink cartridge information is written is affixed to the flat bottom surface of this recessed shoulder 35.

A rectangular recess 37 that is recessed into the width is formed at a front bottom corner part of the side surface 33 of the cartridge case 21 in the cartridge insertion direction, and a wedge-shaped engagement tab 38 for locking the ink cartridge 20 in the loaded position protrudes from the bottom end of this rectangular recess 37.

Internal Configuration of the Ink Cartridge

Figure 4:
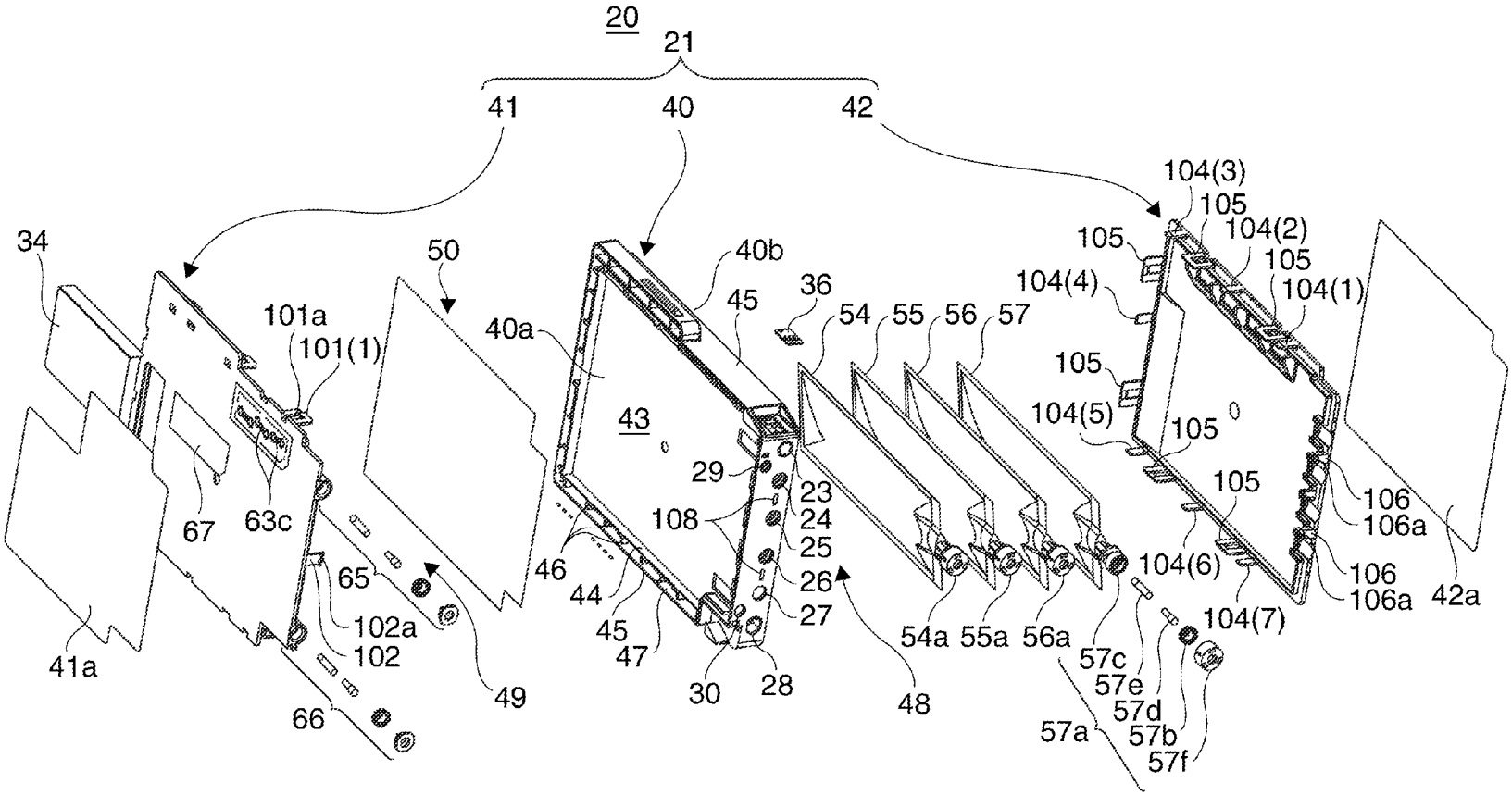
FIG. 4 is an exploded oblique view of the ink cartridge.

FIG. 4 is an exploded oblique view showing an example of the internal configuration of the ink cartridge 20. As shown in this figure, the cartridge case 21 (main container) of the ink cartridge 20 includes a case core 40 (first container forming member, frame member), and a cover panel 41 (second container forming member, first cover panel) and a cover panel 42 (third container forming member, second cover panel) that are attached to opposite sides of the case core 40. These parts 40, 41, and 42 are plastic injection moldings.

The case core 40 has a rectangular divider panel part 43, a rectangular inside frame panel part 44 (first frame panel part) formed in unison with and enclosing the outside edge of the divider panel part 43, and an outside frame panel part 45 (second frame panel part) that is formed around the inside frame panel part 44. The space between the inside and outside frame panel parts 44, 45 is joined by flat ribs 46 with a specific gap therebetween, and slots 47 of a specific width and length are formed between the flat ribs 46. The slots 47 pass from a first open end 40*a* thereof that is covered by one cover panel 41 of the rectangular frame-shaped case core 40 to an opposite second open end 40*b* that is covered by the other cover panel 42.

Note that the inside frame panel part 44 does not need to be disposed around the entire divider panel part 43, and may be rendered only where required to form at least the slots 47. In other words, the divider panel part 43 and the outside frame panel part 45 may be directly connected parts. Alternatively, in the areas where forming the slots 47 is not necessary, the frame panel parts 44 and 45 may be formed in unison with no gap between the inside frame panel part 44 and the outside frame panel part 45.

An ink storage unit 48 is formed by the divider panel part 43 and inside frame panel part 44 of the case core 40 and one cover panel 42, and a waste ink storage unit 49 is formed on the other side of the case core 40 by the other cover panel 41. A label 42*a* is affixed to the outside side of the cover panel 42, and another label 41*a* is affixed to the outside side of the other cover panel 41.

Four ink sacks 54 to 57 storing cyan, magenta, yellow, and black ink are housed inside the ink storage unit 48. The ink supply ports 54*a* to 57*a* of the ink sacks 54 to 57 are coaxially attached to the ink supply needle insertion holes 24 to 27 formed in the front face 22 of the outside frame panel part 45. The ink supply ports 54*a* to 57*a* are identically structured, are defined by a round rubber seal, and have a normally-closed valve mechanism disposed behind the rubber seal. Using ink supply port 57*a* by way of example, each ink supply port 57*a* has a round rubber seal 57*b*, a cylindrical frame 57*c* that holds the rubber seal 57*b*, a columnar valve body 57*d* disposed behind the rubber seal 57*b*, and a spring member 57*e* that presses the valve body 57*d* against the back of the rubber seal 57*b*, and the ink supply port 57*a* is normally closed. So that the rubber seal 57*b* does not separate from the cylindrical frame 57c, a cap 57*f* is attached to the cylindrical frame 57*c*.

Figure 5:
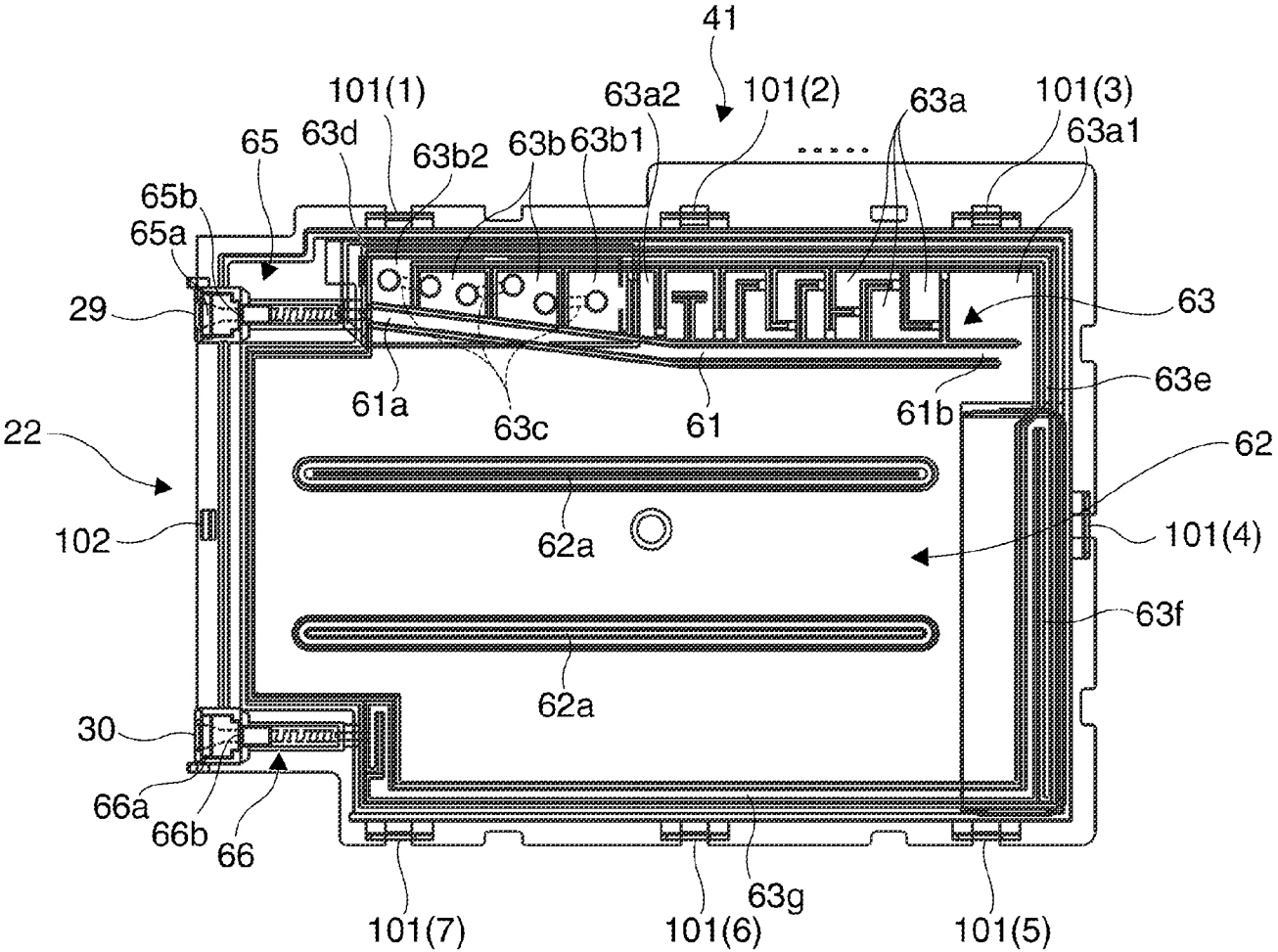
FIG. 5 describes the structure of the waste ink storage unit of the ink cartridge.

FIG. 5 is a plan view showing the inside surface of the cover panel 41, and describes the structure of the waste ink storage unit 49 of the ink cartridge 20. Referring to FIG. 4 and FIG. 5, the waste ink storage unit 49 on the cover panel 41 side is formed between the inside surface of the cover panel 41 and a rigid film 50 affixed thereto. A waste ink recovery path 61 is formed near the top between the waste ink storage unit 49 and the film 50. The bottom side of this waste ink recovery path 61 is a waste ink recovery chamber 62 and the top of the waste ink recovery path 61 is an air chamber 63.

The front end 61*a* at the front of the waste ink recovery path 61 in the ink cartridge loading direction communicates with a waste ink recovery port 65.

The waste ink recovery port 65 is coaxially connected to a waste ink recovery needle insertion hole 29 formed in the front face 22 of the cartridge case 21. The waste ink recovery port 65 has a round rubber seal 65*a* that is spread open by the waste ink recovery needle 89 described below (see FIG. 6A and FIG. 6B), and a normally-closed valve mechanism 65*b* that opens the waste ink recovery port 65 when the waste ink recovery needle 89 inserted to the rubber seal 65*a* is inserted in the normally-closed valve mechanism 65*b*. The back end 61*b* of the waste ink recovery path 61 communicates with the waste ink recovery chamber 62 at the back end of the cartridge case 21 in the ink cartridge loading direction. The waste ink recovery chamber 62 is divided vertically into three chambers by two horizontal ribs 62*a* formed on the flat inside surface of the cover panel 41 with a specific height extending in the ink cartridge loading direction. These internal chambers communicate with each other at the front and back ends in the ink cartridge loading direction.

The air chamber 63 at the top has a plurality of first chamber groups 63*a* that are separated by a plurality of ribs formed on the inside surface of the cover panel 41 at a part on the back side in the ink cartridge loading direction. Of these first chamber groups 63*a*, the chamber 63*a*1 located farthest upstream in the air discharge direction communicates with the waste ink recovery chamber 62. In each chamber in the first chamber groups 63*a*, the location of the communication hole with the adjacent chamber on the upstream side, and the location of the communication hole with the chamber adjacent on the downstream side, are vertically offset from each other perpendicularly to the ink cartridge loading direction so that waste ink can be prevented or suppressed from flowing to the air chamber on the downstream side.

A plurality of second chamber groups 63*b* are arrayed in front in the ink cartridge loading direction of the chamber 63*a*2 that is the farthest of the first chamber groups 63*a* downstream. Of the second chamber groups 63*b*, the chamber 63*b*1 that is the farthest upstream of the second chamber groups 63*b* communicates with chamber 63*a*2. Each chamber in the second chamber group 63*b* communicates with chambers downstream through a communication channel 63*c* that is formed in the surface on the opposite side of the cover panel 42 (outside surface). As will be known from FIG. 4, the communication channel 63*c* is closed by applying a film 67.

The chamber 63*b*2 that is furthest downstream in the second chamber group 63*b* communicates with an air ventilation channel 63*d* that extends in the ink cartridge loading direction and is formed along the top edge of the cover panel 42. The back end of the air channel 63*d* communicates with an air channel 63*e* that extends down along the back end edge of the cover panel 41.

The air channel 63*e* branches in two at some point in the middle, one branch communicating with a fluid collection space 63*f* that extends downward, and the other lower end communicating with an air channel 63*g* that extends to the front in the ink cartridge loading direction along the bottom edge of the cover panel 42. The front end of the air channel 63*g* communicates with air port 66. The air port 66 in this embodiment of the invention renders an air needle insertion hole 30. A round rubber seal 66*a* and a normally-closed valve mechanism 66*b* are disposed to the air port 66. The normally-closed valve mechanism 66*b* opens the air needle insertion hole 30 when pushed and opened by an air needle 90 (see FIG. 6A and FIG. 6B), which is an air ventilation member that is pushed into the rubber seal 66*a*.

Configuration of the Ink Cartridge Loading Unit

Figure 6B:
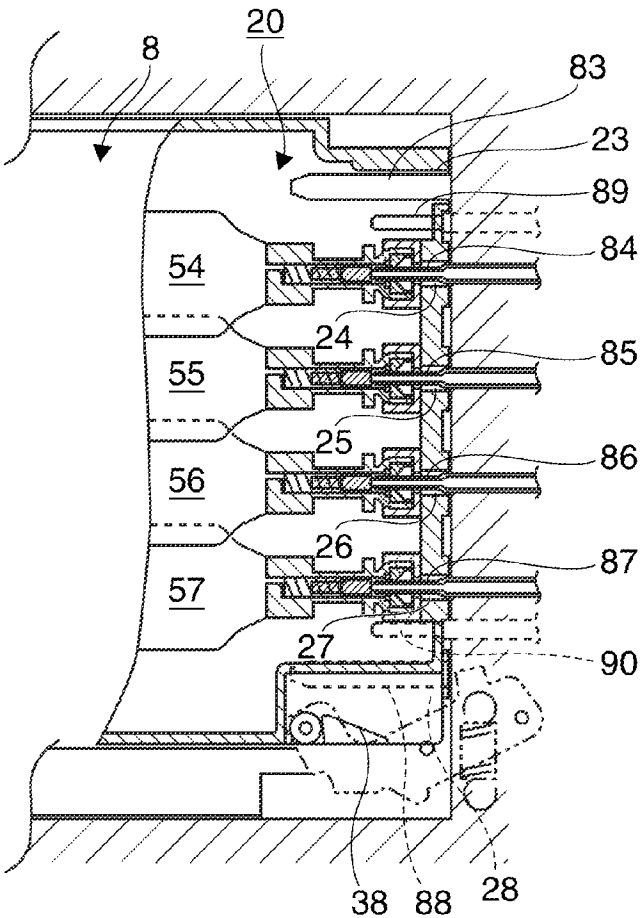
FIG. 6A and FIG. 6B describe the ink cartridge loading unit.
Figure 6A:
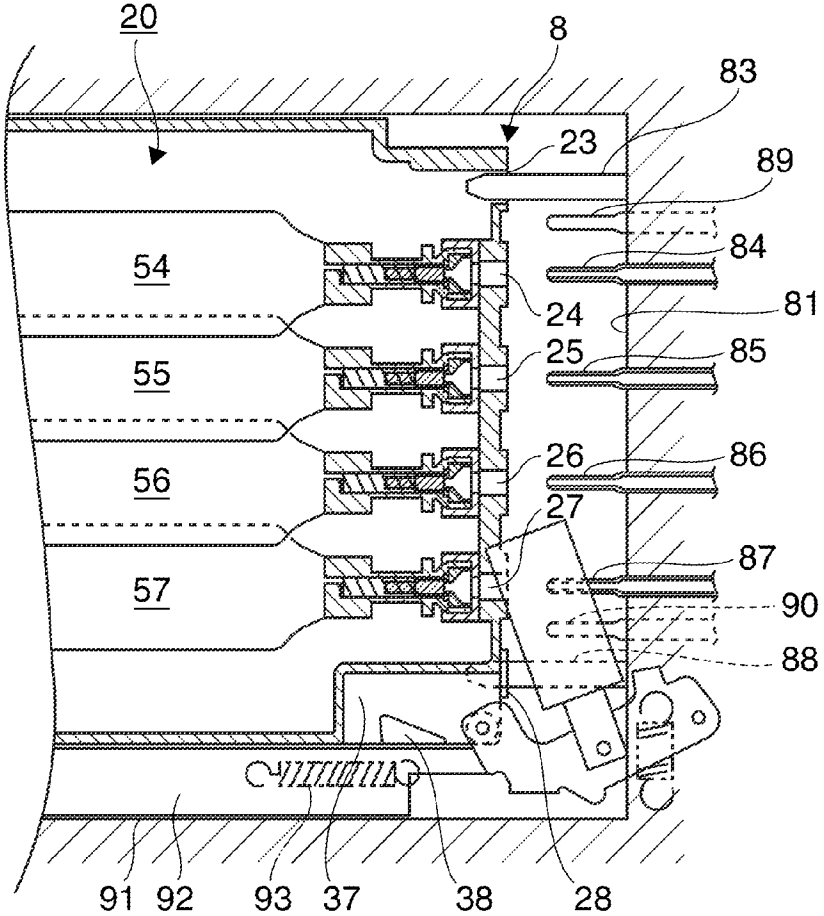

FIG. 6A and FIG. 6B describe the back end part of the ink cartridge loading unit 8 of the inkjet printer 1. As shown in the figures, a plurality of insertion needles protrude from the back end 81 of the ink cartridge loading unit 8 toward the front of the printer parallel to the direction in which the ink cartridge 20 is installed and removed. In this embodiment of the invention a positioning pin 83, four ink supply needles 84 to 87, and rotation prevention pin 88 are disposed in order from the top at one side (the outside) of the width of the back end 81. On the other side of the width (the inside), the waste ink recovery needle 89 is disposed near the top, and the air needle 90 is disposed near the bottom.

A slide plate 92 that can slide in the front-back direction of the printer, that is, the ink cartridge loading direction, is disposed to the bottom 91 of the ink cartridge loading unit 8. A tension spring 93 that extends in the ink cartridge loading direction is disposed between the slide plate 92 and a position on the printer side. When the ink cartridge 20 is inserted to the ink cartridge loading unit 8, the ink cartridge 20 engages the slide plate 92, and the slide plate 92 is pushed with the ink cartridge 20 towards the back of the printer (in the ink cartridge loading direction). When the slide plate 92 is pushed to a position to the back of the printer from the position shown in FIG. 6A, the tension spring 93 extends and the force of the spring works on the slide plate 92 in the direction pushing the slide plate 92 in the opposite direction as the ink cartridge loading direction, that is, toward the printer front. As shown in FIG. 6A, when the ink cartridge 20 is inserted to the ink cartridge loading unit 8, the positioning pin 83 and rotation prevention pin 88 are first pushed into the positioning pin insertion hole 23 and rotation prevention pin insertion hole 28, respectively, that are formed in the front face 22 of the ink cartridge 20. The ink cartridge 20 is thus positioned while being inserted to the ink cartridge loading unit 8. Thereafter, the ink supply needles 84 to 87, waste ink recovery needle 89, and air needle 90 are respectively inserted to the ink supply needle insertion holes 24 to 27, waste ink recovery needle insertion hole 29, and air needle insertion hole 30.

As shown in FIG. 6B, when the ink cartridge 20 is inserted completely to the ink cartridge loading unit 8, the ink cartridge 20 is locked in the loaded position with the normally-closed valve mechanisms that close the ink supply needle insertion holes 24 to 27, waste ink recovery needle insertion hole 29, and air needle insertion hole 30 opened by the ink supply needles 84 to 87, waste ink recovery needle 89, and air needle 90, respectively. The ink supply paths that supply the color ink from the ink sacks 54 to 57 of the ink cartridge 20 through the ink supply needles 84 to 87 to the inkjet head 13 are thus formed. A waste ink recovery path from the head maintenance unit 19 side through the waste ink recovery needle 89 to the waste ink recovery chamber 62 of the ink cartridge 20 is also formed. In addition, the waste ink recovery chamber 62 of the ink cartridge 20 is open to air through the air needle 90.

Cartridge Case Assembly Structure

The assembly structure of the case core 40 and the cover panels 41 and 42 rendering the cartridge case 21 is described next. The cover panel 41 and cover panel 42 are removably attached to the case core 40 with the case core 40 therebetween.

The structure for attaching the cover panel 41 to the case core 40 is described first.

As shown in FIG. 4 and FIG. 5, a plurality of first latch plates 101(1)-101(7) that extend perpendicularly to the side of the case core 40 are formed with a regular interval therebetween along the outside edge part on the side of the cover panel 41. In this embodiment of the invention, as will be understood from FIG. 5, first latch plates 101(1), 101(2), 101(3), 101(5), 101(6), 101(7) having the same shape are formed at three locations along the edges of both long sides. One first latch plate 101(4) is formed at the edge of the short side in the middle of the back in the ink cartridge loading direction. The first latch plates 101(1)-101(7) are rectangular frame shapes with a rectangular catch hole 101*a* formed in the middle.

At the front edge of the cover panel 41 in the ink cartridge loading direction, a single first lance 102 of a constant width is formed extending perpendicularly to the side of the case core 40. A hook-shaped claw 102*a* that protrudes to the outside is formed at the distal end of the first lance 102.

Figure 7B:
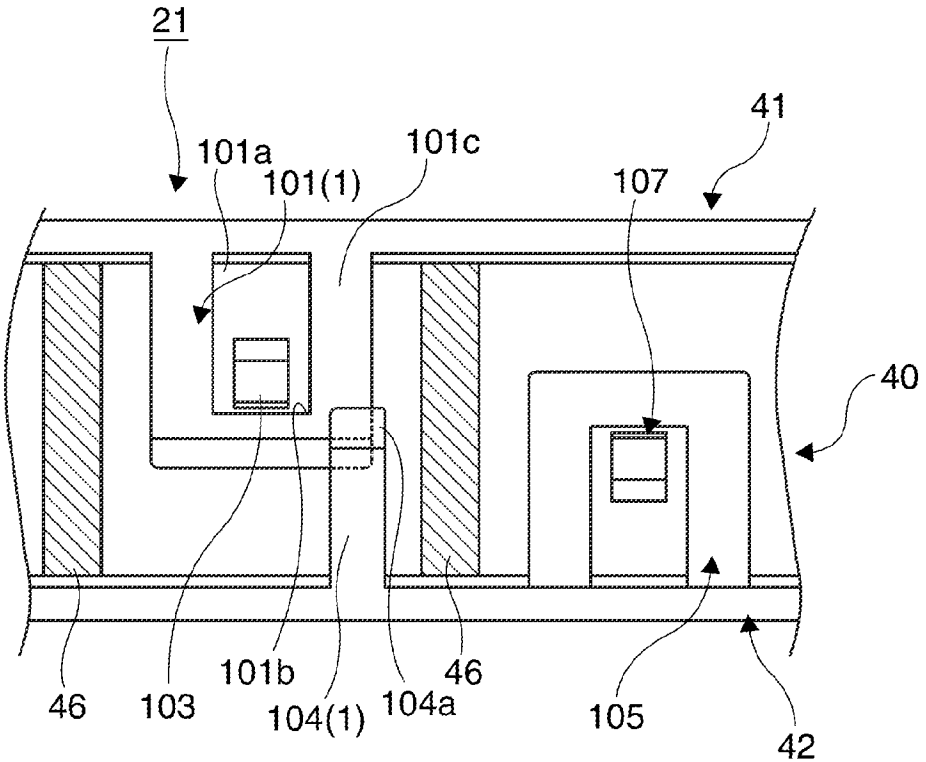
FIG. 7A and FIG. 7B are partial section views showing the locking mechanism of the ink cartridge.
Figure 7A:
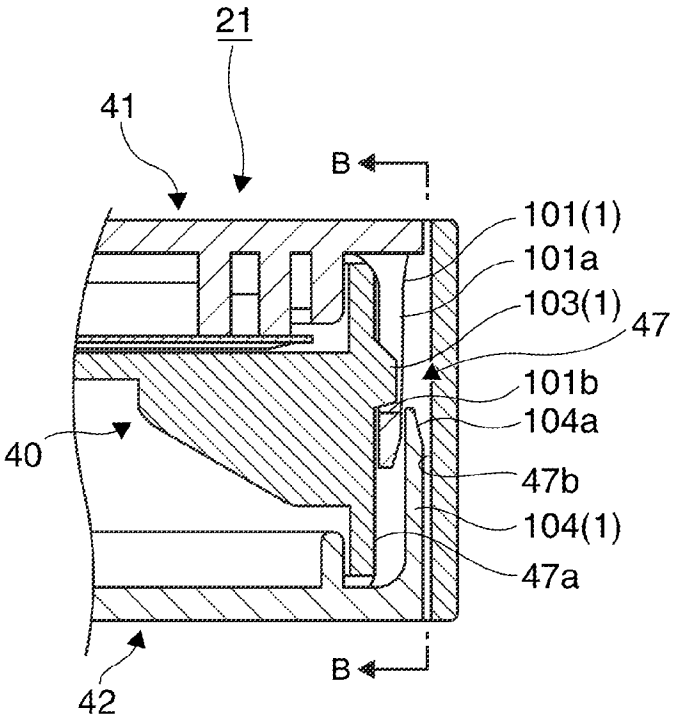
Figures 8A, 8B:
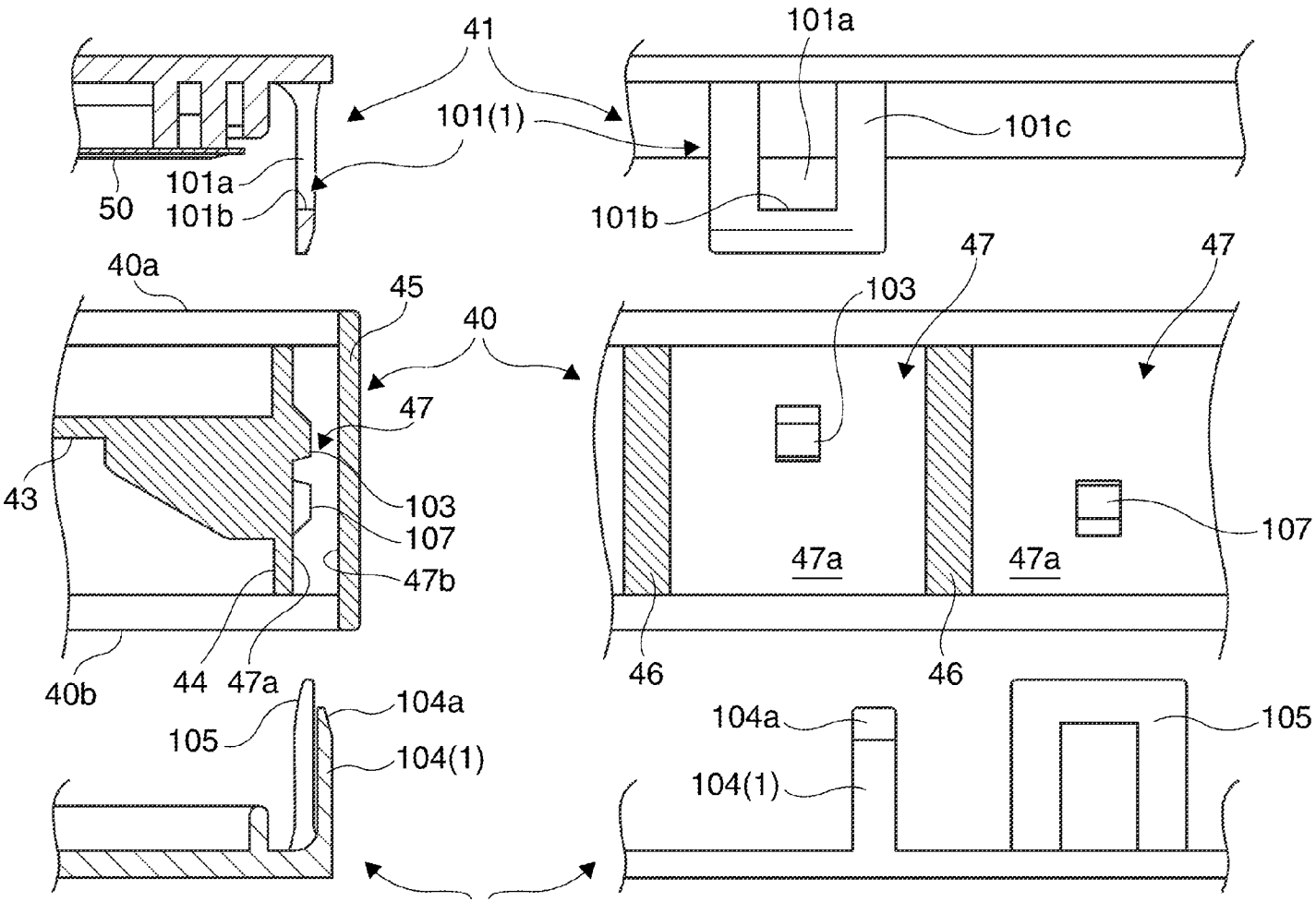
FIG. 8A and FIG. 8B are partially exploded views of the ink cartridge locking mechanism.

FIG. 7A is a partial section view of the parts through lines A-A in FIG. 3A and FIG. 3B. FIG. 7B is a partial section view through line B-B in FIG. 7A. FIG. 8A is an exploded view of the partial section view shown in FIG. 7A, and FIG. 8B is an exploded view of the partial section view shown in FIG. 7B, before the cover panels 41 and 42 are assembled to the case core 40.

Referring to FIG. 7A, FIG. 7B, FIG. 8A, and FIG. 8B, of the plural slots 47 formed along the outside edge of the case core 40, first catches 103 (first engaging units) are formed to the inside slot surface 47*a* (first side) located inside of the case core 40 of each slot 47 formed at a position corresponding to the first latch plates 101(1)-101(7). These first catches 103 protrude a specific amount toward the side of inside slot surface 47*b* (second side) on the outside side of the slot opposite the inside slot surface 47*a*. The inside slot surface 47*a* is the surface on the outside side of the inside frame panel part 44, and the inside slot surface 47*b* is the surface on the inside side of the outside frame panel part 45.

As shown in FIG. 8A and FIG. 8B, when the cover panel 41 positions the first open end 40*a* of the case core 40, the first latch plate 101(1) extends in the direction along the inside slot surface 47*a*. When the first latch plate 101(1) is inserted to the slot along the inside slot surface 47*a*, the distal end of the first latch plate 101(1) contacts the first catch 103 and rides over the first catch 103 while elastically deforming. When the distal end of the first latch plate 101(1) rides over the first catch 103, that is, when the inside edge of the distal end 101*b* rides over the first catch 103, the first latch plate 101(1) elastically returns to the inside slot surface 47*a* side, and as shown in FIG. 7A and FIG. 7B the first latch plate 101(1) is held by the first catch 103.

Note that each of the other first latch plates 101(2)-101(7) engage the matching first catch 103 in the same way.

The one first lance 102 formed to the front edge of the cover panel 41 in the ink cartridge loading direction is inserted to a corresponding slot (not shown in the figure) on the case core 40 side. A catch (not shown in the figure) that the claw 102*a* of the first lance 102 can engage is formed on the inside surface (not shown in the figure) of this slot. The inside slot surface to which this catch is formed is a surface on the inside of the outside frame panel part 45. The first lance 102 also engages this catch not shown.

As described above, the cover panel 41 is removably attached to the side on the first open end 40*a* of the case core 40 by seven sets of first catches 103 and first latch plates 101(1)-101(7), and one set of a first lance 102 and corresponding catch not shown.

As shown in FIG. 4, locking tabs 104(1)-104(7) are formed at positions corresponding to the first latch plates 101(1)-101(7) along the outside edge part on the side of the other cover panel 42. The locking tabs 104(1)-104(7) are flat fingers of a constant width and length extending perpendicularly to the side of the case core 40 from the outside edge part of the cover panel 42. The locking tabs 104(1)-104(7) are used to restrict elastic deformation of the first latch plates 101(1)-101(7) so that the first latch plates 101(1)-101(7) do not disengage the first catch 103.

As shown in FIG. 8A and FIG. 8B, when the cover panel 42 is positioned to the second open end 40*b* on the other side of the case core 40, and the cover panel 42 is attached to the second open end 40*b*, the locking tabs 104(1)-104(7) are inserted to the corresponding slots 47 of the case core 40. Using locking tab 104(1) for example, the locking tab 104(1) is separated from the inside slot surface 47*a* of the slot 47 by approximately the thickness of the first latch plate 101(1), is separated from the other inside slot surface 47*b* by an even narrower gap, and overlaps the frame part 101*c* of the first latch plate 101(1).

When the locking tab 104(1) is inserted to the slot 47, part of the first latch plate 101(1) (the distal end part of the frame part 101*c*) is held between the distal end part 104*a* and the inside slot surface 47*a* as shown in FIG. 7A and FIG. 7B. As a result, elastic deformation of the first latch plate 101(1) in the direction away from the inside slot surface 47*a* is restricted. Therefore, because deflection of the first latch plate 101(1) away from the first catch 103 is prevented, these parts remain engaged even if the ink cartridge 20 is dropped or otherwise subject to a strong shock.

The cover panel 41 will therefore not separate from the case core 40. As a result, the length of the first latch plate 101(1) can be increased so that it can be easily deflected and the cover panel 41 can be easily attached to and removed from the case core 40. Furthermore, because concentration of stress on the base part of the first latch plate 101(1) can be alleviated, damage and other problems resulting from plastic deformation, stress whitening, and embrittlement of this part can be prevented.

The structure for attaching the other cover panel 42 to the case core 40 is described next with reference to FIG. 4, FIG. 7A, FIG. 7B, FIG. 8A, and FIG. 8B.

Second latch plates 105 that extend perpendicularly to the side of the case core 40 are formed at a specific interval around the outside edge on the cover panel 42 side. In this embodiment of the invention second latch plates 105 of the same shape are formed at two locations on the edges of both long sides. Two second latch plates 105 are also formed on the edge of the short side at positions on both ends of the edge on the back side in the ink cartridge loading direction. These second latch plates 105 are shaped identically to the first latch plates 101, and are formed at positions not interfering with the first latch plates 101, that is, at positions enabling insertion to different slots 47 in the case core 40.

Two second lances 106 of a constant width are formed extending perpendicularly to the side of the case core 40 at the middle of the front edge of the cover panel 42 in the ink cartridge loading direction. A hook shaped claw 106*a* that bends to the outside is formed on the distal end of the second lance 106.

As shown in FIG. 7B and FIG. 8B, a second catch 107 shaped identically to the first catch 103 is formed to the inside slot surface 47*a* of the slots 47 to which the second latch plates 105 are inserted in the case core 40. As shown in FIG. 4, engaging grooves 108 are formed through the outside frame panel part 45 in the slots 47 to which the second lances 106 are inserted.

When the cover panel 42 is positioned to the second open end 40*b* side of the case core 40, the second latch plates 105 and second lances 106 of the cover panel 42 are inserted to the corresponding slots 47. The claw 106*a* on the distal end of the second lances 106 fits into the engaging groove 108 in the slot 47, and the second latch plate 105 engages the second catch 107 formed on the inside slot surface 47*a* of the slot 47.

As described above, locking tabs 104(1)-104(7) are formed on the cover panel 42. As shown in FIG. 7A and FIG. 7B, the distal end parts 104*a* of these locking tabs 104(1)-104(7) contact the distal end parts of the first latch plates 101(1)-101(7) of the other cover panel 41, and the opposite side is opposite the inside slot surface 47*b* with a small gap therebetween. Therefore, even if the ink cartridge 20 is dropped and a strong force that works to slide the cover panel 42 along the side of the case core 40 is applied, the second latch plates 105 and second lances 106 remain engaged because deflection of the locking tabs 104(1)-104(7) is limited. Separation of the cover panel 42 from the case core 40 can thus be prevented.

Note that while not described in detail above, the distal ends of the first latch plates 101(1)-101(7), first catches 103(1) to 103(7), and locking tabs 104(1)-104(7) are tapered so that the engaging action is smooth. The ends of the second latch plates 105 and second lances 106 are likewise tapered.

As described above, a mechanism whereby the first catches 103 (first engaging units) and first latch plates 101(1)-101(7) disengage when the first latch plates 101(1)-101(7) (second engaging units) are elastically deformed forcibly is used in the ink cartridge 20 according to this embodiment of the invention as an locking mechanism that enables assembling the case core 40 (first container forming member) and cover panel 41 (second container forming member) rendering the cartridge case 21 (main container) so that they can be disassembled. In addition, elastic deformation of the first latch plates 101(1)-101(7) is limited by the locking tabs 104(1)-104(7) (engagement holding units) formed on the cover panel 42 (third container forming member) that is removably attached to the case core 40.

Therefore, the locking mechanism will not disengage and the cover panel 41 will not separate from the case core 40 unless the cover panel 42 is removed from the case core 40. As a result, a locking mechanism that can be easily disengaged with little force can be used, and the cartridge case 21 will not come apart as a result of the impact of being dropped, for example.

Elastic deformation and movement of the locking tabs 104(1)-104(7) is restricted by the inside slot surface 47*b* (limiting unit) formed in the case core 40. Because elastic deformation and movement of the locking tabs 104(1)-104(7) is limited by the inside slot surface 47*b* even when the cover panel 42 moves temporarily as a result of the shock of being dropped, the locking tabs 104(1)-104(7) can be prevented from separating greatly from and disengaging the first latch plates 101(1)-101(7), and the cover panel 41 can be prevented from separating from the case core 40. In addition, because shifting of the cover panel 42 relative to the case core 40 is also limited by the inside slot surface 47*b*, separation of the cover panel 42 from the case core 40 can also be prevented.

Other Embodiments

This embodiment of the invention describes a rectangular ink cartridge 20, but the shape of the ink cartridge 20 is not so limited and other shapes can be used.

Furthermore, the ink cartridge 20 in the foregoing embodiment of the invention has an ink storage unit and a waste ink storage unit, but the invention can obviously be applied to fluid containers that have only an ink storage unit or only a waste ink storage unit.

The fluid container of the invention is described in the foregoing as an ink cartridge that is used as an ink supply source in an inkjet printer, but the fluid container of the invention can also be used in fluid containers used in fluid discharge heads for discharging a variety of fluids, including color agent discharge heads used in manufacturing color filters for liquid crystal displays, electrode material discharge heads used for forming electrodes in organic EL display and FED (field emission display) devices, and bio-organic material discharge heads used in biochip manufacture. The invention can also be used in a fluid container that is used in a reagent discharge device used as a precision pipette.

The concept of a fluid as used herein also includes gels, high viscosity materials, and mixtures of a solid in a solvent. Inks include aqueous inks, oil-based inks, dye-based inks, and pigment-based inks Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A fluid container comprising:

a main container; and a fluid storage unit that is formed inside the main container;

wherein the main container is composed of at least three members including a first container forming member, a second container forming member and a third container forming member, the second container forming member and the third container forming member are removably attached to the first container forming member with the first container forming member therebetween, a locking mechanism for removably attaching the second container forming member to the first container forming member includes a first engaging unit formed to the first container forming member, a second engaging unit formed to the second container forming member, and an engagement holding unit disposed to the third container forming member, the second engaging unit engages the first engaging unit and can be elastically deformed and separated from the first engaging unit, and the engagement holding unit restricts elastic deformation of the second engaging unit so that the second engaging unit does not separate from the first engaging unit.

2. The fluid container described in claim 1, wherein:

the first container forming member has a limiting unit that restricts movement of the engagement holding unit away from the second engaging unit.

3. The fluid container described in claim 2, wherein:

the first container forming member has a first side and a second side that is disposed opposite the first side with a specific gap therebetween, the second side being the limiting unit;

the first engaging unit is a protruding catch that protrudes from the first side toward the second side;

the second engaging unit is a latch plate that extends in a direction along the first side;

the latch plate has an inside engaging edge that engages the protruding catch from a direction along the first side, and can deform elastically away from the first side;

the engagement holding unit is a locking tab that extends in a direction along the first side between the latch plate and the second side; and the locking tab holds at least part of the latch plate between the locking tab and the first side.

4. The fluid container described in claim 3, further comprising:

a second locking mechanism that removably attaches the third container forming member to the first container forming member;

wherein the second locking mechanism includes a second protruding catch that protrudes from the first side of the first container forming member toward the second side, and a second latch plate formed on the third container forming member; and the second latch plate has an inside engaging edge that extends in a direction along the first side and engages the protruding catch from a direction along the first side, the second latch plate disengaging the second protruding catch when elastically deformed in the direction away from the first side.

5. The fluid container described in claim 4, wherein:

the locking mechanism is disposed at plural locations a specific interval apart along the outside edge of the first container forming member.

6. The fluid container described in claim 5, wherein:

the first container forming member is a frame member of which both ends are open;

the second container forming member is a first cover panel that closes a first opening on one side of the frame member;

the third container forming member is a second cover panel that closes a second opening on the other side of the frame member;

the frame member has a plurality of slots of a specific width and specific length that pass through from the first cover panel to the second cover panel at positions corresponding to the locations of the locking mechanisms;

the side surface of each slot positioned on the inside side of the frame member is the first side, and the side surface positioned on the outside side is the second side; and the latch plate of the locking mechanism is inserted to the slot from the first opening side, and the locking tab is inserted from the second opening side.

7. The fluid container described in claim 6, wherein:

the fluid storage unit includes a supply fluid storage unit that stores a supply fluid, and a recovery fluid storage unit that stores a recovery fluid that is recovered from an external source;

either one of the supply fluid storage unit and the recovery fluid storage unit is disposed on the first cover panel side, and the other is disposed on the second cover panel side; and the frame member has formed therein a supply fluid port for supplying supply fluid from the supply fluid storage unit to an external device, and a fluid recovery port for recovering fluid from an external device to the recovery fluid storage unit.

8. The fluid container described in claim 7, wherein:

the supply fluid storage unit is a supply ink storage unit for storing ink that is supplied to an inkjet printer; and the recovery fluid storage unit is a waste ink storage unit for recovering waste ink discharged from the inkjet printer.

9. A fluid container comprising:

a first container forming member that has a divider panel part, a first frame panel part formed to surround the divider panel part, and a second frame panel part that is connected to the first frame panel part and is formed around the first frame panel part; and a second container forming member and a third container forming member that are removably attached to the first container forming member with the divider panel part of the first container forming member therebetween;

wherein the first container forming member includes a first protruding catch and a second protruding catch that are formed on the first frame panel part protruding toward the second frame panel part;

the second container forming member includes an elastically deformable first latch plate that is the first latch plate with a first engaging hole for engaging the first protruding catch; and the third container forming member includes an elastically deformable second latch plate that is the second latch plate with a second engaging hole for engaging the second protruding catch, and an engagement holding unit that contacts part of the first latch plate and limits elastic deformation of the first latch plate to the second frame panel part side.

* * * * *